United States Patent [19]

MacLennan

[11] 4,117,436

[45] Sep. 26, 1978

[54] TORQUELESS RELATIVELY MOVING TRANSFORMER WINDINGS

[75] Inventor: Alexander G. MacLennan, Harvard, Mass.

[73] Assignee: The Charles Stark Draper Laboratory, Inc., Cambridge, Mass.

[21] Appl. No.: 716,707

[22] Filed: Aug. 23, 1976

[51] Int. Cl.[2] ..... H01F 15/02

[52] U.S. Cl. ..... 336/65; 336/83; 336/117; 336/118; 336/120

[58] Field of Search ..... 336/83, 117, 118, 119, 336/120, 115, 130, 175, 68, 65

[56] References Cited

U.S. PATENT DOCUMENTS

| | | | |
|---|---|---|---|
| 516,846 | 3/1894 | Thomson | 336/129 X |
| 2,009,800 | 7/1935 | Hendricks, Jr. | 336/117 |
| 2,283,712 | 5/1942 | Welch, Jr. | 336/117 X |
| 2,608,610 | 8/1952 | Thulin | 336/83 X |
| 2,786,983 | 3/1957 | Hill | 336/83 |
| 2,949,591 | 8/1960 | Craige | 336/83 |
| 3,101,462 | 8/1963 | Swainson | 336/75 |
| 3,154,757 | 10/1964 | Hannon | 336/175 |
| 3,213,398 | 10/1965 | Marton | 336/129 X |
| 3,425,015 | 1/1969 | Klug | 336/130 |
| 3,430,173 | 2/1969 | Orlando | 336/120 X |
| 3,467,928 | 9/1969 | Cenz | 336/117 X |
| 3,611,230 | 10/1971 | Maake | 336/120 |
| 3,924,174 | 12/1975 | Fahrner | 336/120 X |

FOREIGN PATENT DOCUMENTS

| | | | |
|---|---|---|---|
| 213,236 | 6/1956 | Australia | 336/83 |
| 546,793 | 7/1942 | United Kingdom | 336/118 |

*Primary Examiner*—Thomas J. Kozma
*Attorney, Agent, or Firm*—Weingarten, Maxham & Schurgin

[57] ABSTRACT

A transformer for coupling between relatively moving elements having a limited degree of motion without inducing torques or forces between the elements as the result of fluxes coupling transformer windings. The transformer includes a primary and secondary coil respectively secured to the relatively moving elements and housed within a core structure of high permeability material which provides a low reluctance flux path for the mutual or coupling flux between the transformer primary and secondary windings and a relatively high reluctance path for leakage flux.

7 Claims, 10 Drawing Figures

TORQUELESS RELATIVELY MOVING TRANSFORMER WINDINGS

FIELD OF THE INVENTION

The present invention relates to transformers for coupling between relatively moving elements and in particular, to a transformer which provides reduced forces or torques between windings.

BACKGROUND OF THE INVENTION

Conventional apparatus for coupling between two relatively moving elements, depending upon the application, include such elements as rotary transformers or flex leads. In the case of the rotary transformer in the conventional manner of use, a primary coil is wound upon one element of a relatively moving set, while a secondary coil is wound upon the other element. An air gap typically exists between the two coils necessitating the mutual or coupling flux that results in the transfer of a signal or power between the coils to cross the gap twice in a complete circuit between the coils. This arrangement not only contributes to a high magnetization current which develops a high loss factor in the primary current and low input impedance but permits a fluctuation in signal output at the secondary where variations in the gap are possible. In addition, such a device is susceptible to undesirably large forces or torques developed between the two coils and the elements upon which they are formed.

The flex lead which has use in a device for transmitting electrical signals between relatively moving elements of limited degrees of motion, avoids the difficulties of rotary transformers attributable to the less than ideal flux path found in rotary transformers, but has its own deficiencies which include a potentially more limited degree of motion permitted between the moving elements, flex lead creep resulting from thermal and aging factors, as well as a greater susceptibility to damage from mechanical shock.

BRIEF SUMMARY OF THE INVENTION

In accordance with the preferred embodiment of the present invention, there is described a transformer for coupling electrical signals between relatively moving elements of limited motion which provides high efficiency in the transfer of electrical power without inducing high torques and forces between the transformer windings and associated elements.

In an embodiment of the invention, first and second transformer windings are located within a core structure, typically a high permeability tube having a central spindle passing through the two coils and covered at both ends by a high permeability section which completes the magnetic circuit between the tube and spindle. Mutual or coupling flux between the primary and secondary coils contained within the core structure circulates through the structure free of air gaps, while limited motion between the two coils is permitted by a rigid support applied to one or both of the transformer coils through small apertures in the tube or covers. These apertures permit the requisite limited degree of motion without significantly increasing the reluctance of the flux path for the mutual or coupling inductance. The leakage flux passes through the air gap between the elements, typically between the tube and spindle, of the core structure.

The transformer fabricated in accordance with this teaching has a low reluctance flux path for the coupling inductance thereby having a low magnetization current. This contributes to a lower loss factor in the primary current in combination with a high input impedance. Since the coupling efficiency is not dependent upon a variable air gap, there is less need to regulate the transformer output signal against the variations in the transformer coupling. The structure also results in low forces and torques generated between the two transformer coils and associated elements with which they move as a result of variations in flux path reluctance with coil position.

BRIEF DESCRIPTION OF THE DRAWINGS

These and other features of the present invention are more fully set forth below in the solely, exemplary and nonlimiting detailed description of the invention and accompanying drawing of which.

DETAILED DESCRIPTION OF THE INVENTION

Figure 1:
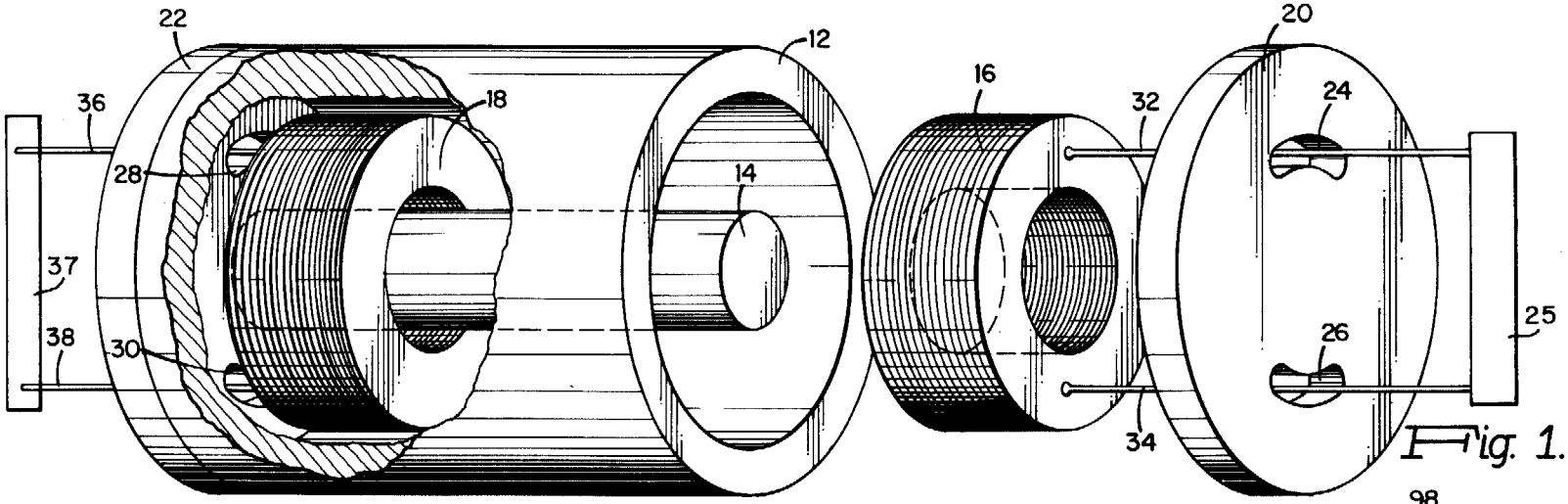
FIG. 1 is a pictorial, expanded view of a first embodiment of a transformer according to the present invention.

The present invention contemplates a system for coupling electrical signals of high efficiency between relatively moving elements of limited motional extent without inducing substantial torques and forces between the relatively moving elements. A first embodiment of the invention is illustrated in FIG. 1 showing a pictorial, exploded view thereof. The transformer of FIG. 1 includes a cylindrical tube member 12, preferably of a high permeability material such as Ferrite having coaxially therein a spindle 14 of similar high permeability material. Fitting within the tube 12 and around the spindle 14 are primary and secondary windings 16 and 18 of the transformer. End sections 20 and 22 which may be separate or integral, close the ends of the tube 12 and provide a low reluctance, high permeability flux circuit between the tube 12 and spindle 14.

The end sections 20 and 22 are shown to have apertures 24 and 26 in the section 20 and apertures 28 and 30 in the section 22. Support rods 32 and 34 pass through the apertures 24 and 26 in the end section 20 to contact the coil 16 and rigidly secure it to an external element 25. Similarly, support rods 36 and 38 pass through the apertures 28 and 30 to rigidly secure the coil 18 to a further member 37 which is to have a limited rotational motion with respect to the first element 25. The apertures 24, 26, 28 and 30 are shaped to form annular sections of circular bands to permit the desired degree of motion.

The spindle 14 may be secured to the end sections 20 and/or 22 by integral or bolt attachments or otherwise as is desired. In addition, the support rods 32, 34, 36 and 38 may be utilized as or combined with conductors to conduct electrical excitation to and from the coils 16 and 18.

Figure 2:
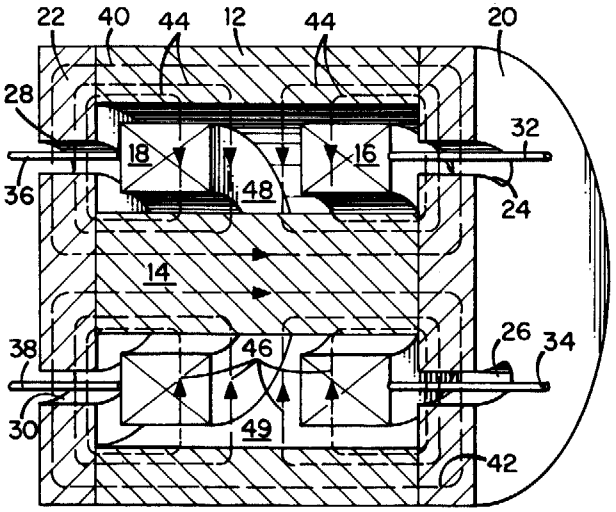
FIG. 2 is a sectional pictorial view of the transformer of FIG. 1 illustrating flux couplings.

With reference now to FIG. 2, a sectional view of the transformer of FIG. 1, the functioning of the transformer according to the present invention may best be understood. As shown in FIG. 2, the coils 16 and 18 will be coupled by mutual or coupling flux 40 and 42 which passes in a circuit consisting substantially of the high permeability members that include the tube 12, spindle 14, and end sections 20 and 22 with only a slight disturbance by the presence of the holes 24, 26, 28 and 30 which do not substantially increase the reluctance of the flux circuit. On the other hand, leakage flux 44 and 46 is forced to traverse respective air gaps 48 and 49.

The low reluctance path of mutual, coupling flux between the coils 16 and 18, flux paths 40 and 42, improve coupling efficiency by reducing the primary magnetizing current resistive losses and increases the input impedance of the device much closer to the impedance determined by the load on the secondary winding 18. Similarly, a resulting reduction in the variation of coupling flux path reluctance with the relative position of coils 16 and 18 improves the output signal regulation or reduces the variation therein from relative coil motion. In addition, while there is some axial force tending to urge the coils 16 and 18 apart increasing the energy in the leakage flux paths 44 and 46, there is relatively low, theoretically zero, force or torque in the direction of relative motion, rotation about the spindle 15, between the coils 16 and 18.

Figure 3:
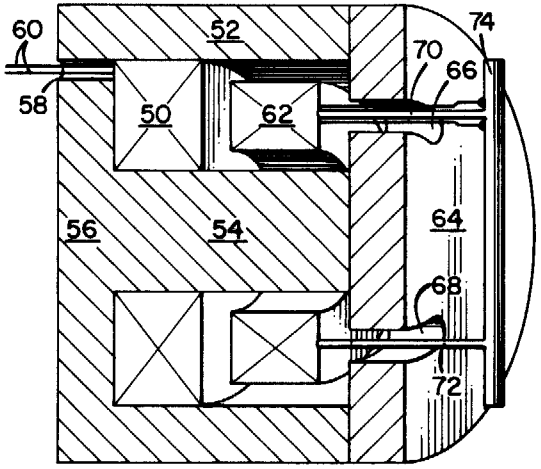
FIG. 3 is a sectional pictorial view of a further embodiment of the invention.

In the embodiment of FIGS. 1 and 2, the primary and secondary coils 16 or 18 are shown to be supported solely by support rods 32 and 34 and rods 36 and 38 and core structure made up of the tube 12, spindle 14, and end sections 20 and 22 uncoupled to the coils and thereby not adding to the weight and inertia of the coil structures. Alternatively, as shown in FIG. 3, one of the coils, such as primary coil 50, may be attached to the core structure consisting of integral outer tube portion 52 and inner spindle portion 54 connected by a rear panel 56 having an aperture 58 to pass electrical connections 60 to the coil 50. A secondary coil 62 is placed about the spindle 54 within the tube 52 and covered by a further end plate 64 which has apertures 66 and 68 to permit passage of rods 70 and 72 from a movable member 74.

Figure 4:
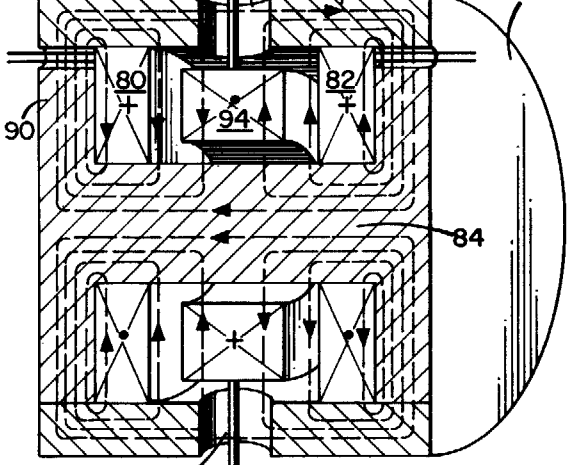
FIG. 4 is a sectional pictorial view of a further embodiment of the present invention.

In a further embodiment illustrated in FIG. 4, a primary coil is divided into first and second sections 80 and 82 about a spindle 84, surrounded by an outer core tube 86 with respective end sections 88 and 90. The primary sections 80 and 82 are placed about the spindle section 84 adjacent the end sections 88 and 90 to permit a secondary coil 92 to be placed around the spindle 84 between the primary sections 80 and 82. Apertures 94 and 96 in the outer core tube 86 permit passage of rods 98 and 100 to support the coil 92 for limited relative motion with respect to the primary coil 80 and 82. In this case, the leakage flux 102 produces balanced axial forces with no net theoretical force between the primaries and the secondary coil.

Figure 5:
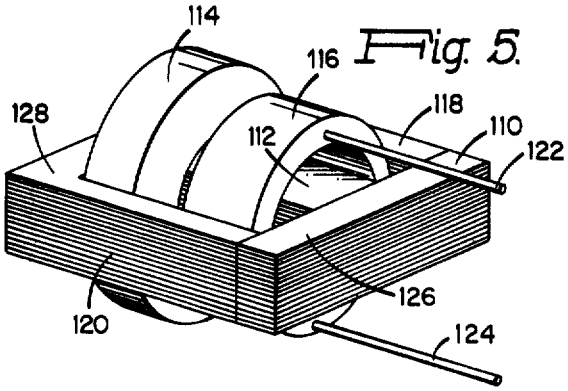
FIGS. 5–6 show a further embodiment using a laminated core.
Figure 6:
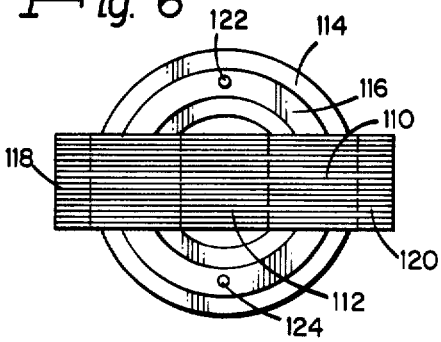

With respect to FIGS. 5 and 6, there is shown a further embodiment of the present invention in which a laminated three-legged core 110 is provided with a central leg 112 having a primary coil 114 and secondary coil 116 wound thereabout through apertures between the central leg 112 and outer legs 118 and 120. A side view illustrated in FIG. 6 provides a further representation.

In typical construction, the coil 114 is nonmovable, secured to the core 110 structure, while the secondary coil 116 is rotatable about the central leg 112 and is separately supported through rods 122 and 124. A substantial angle of rotation for coil 116 is provided by the structure of FIGS. 5 and 6. The core 112 is typically configured by two interleaving E sections in stacks 126 and 128 as shown.

Figure 7:
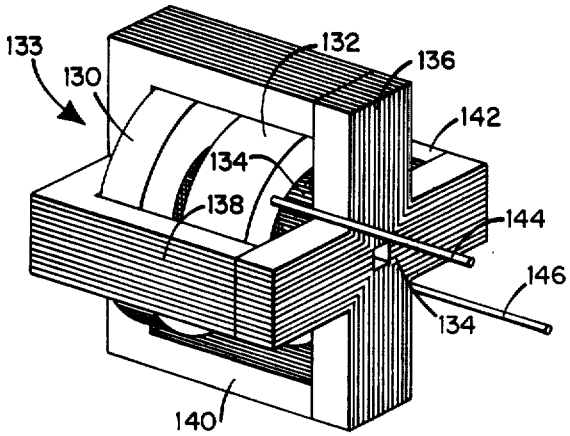
FIGS. 7–8 show a modification to FIGS. 5–6.
Figure 8:
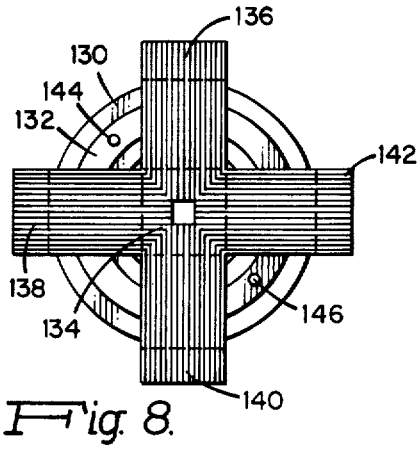

A modification of the embodiment shown in FIGS. 5 and 6 is presented in FIGS. 7 and 8 wherein, instead of a single set of stacked E sections, a laminated core structure forming a cross is provided. In this case, primary and secondary coils 130 and 132 respectively are wound about a central leg 134 of a five-leg core structure 133, with four peripheral legs 136, 138, 140 and 142 evenly spaced about the coils 130 and 132 to provide a mutual flux return path. The primary coil 130 may be secured with respect to the core structure while the secondary coil 132 is movable about the central leg 132 and within the peripheral legs and is separately secured through rods 144 and 146. The structure of FIGS. 7 and 8 provides a decreased flux reluctance but a more limited angle of motion.

Figure 9:
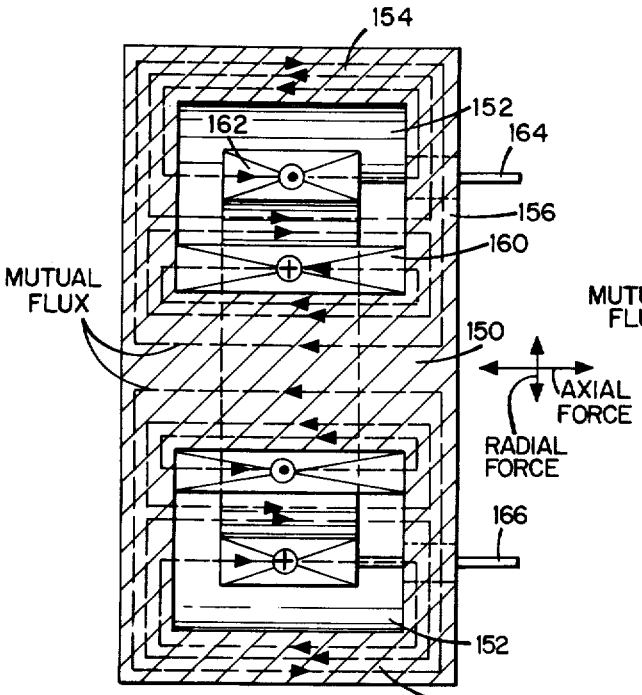
FIG. 9 shows a yet further embodiment.

With respect to FIG. 9, a further modification is illustrated in which a core is composed of a central spindle 150 surrounded by an air gap 152 and outer low reluctance flux path in the shape of a tube 154. The spindle 150 is connected to the tube 154 through low reluctance flux plates 156 and 158 on opposite ends.

A primary coil 160 is wound directly about the spindle 150 while a secondary coil 162 is floated in the air gap 152 between coil 160 and spindle 150. Coil 162 is supported externally by rods 164 and 166 passing through holes in end plate 156 to permit a limited angular rotation of the secondary coil 162.

In the embodiment of FIG. 9, leakage flux produces a radial force on coil 162 distributed evenly around the coil to produce no net radial force effect when the coil is centered about spindle 150. Also, in this case, barring physical irregularities in coil and core structure, the axial force and rotational torques are both zero.

Figure 10:
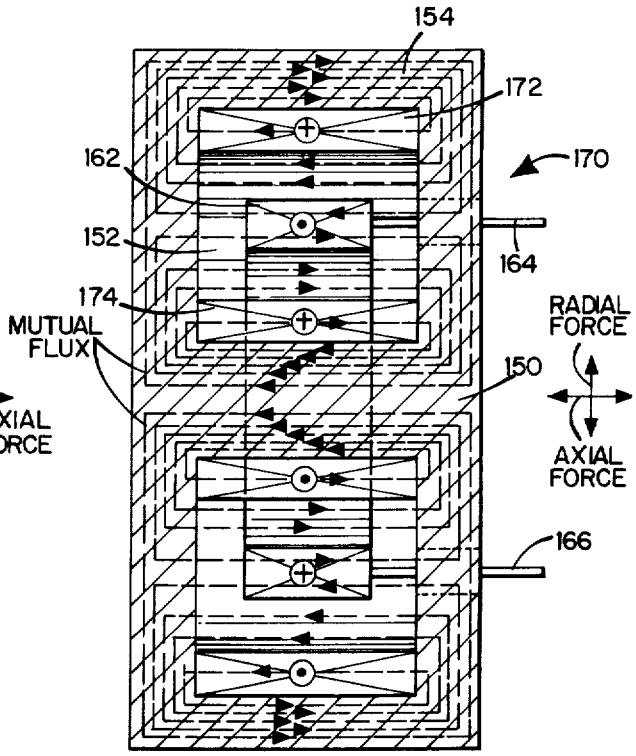
FIG. 10 shows a modification to FIG. 9.

A modification to the embodiment of FIG. 9 is shown in FIG. 10. As shown there, a core structure 170 is provided substantially similar to the core structure in FIG. 9. In this case, a primary winding has its turns distributed between an outer coil 172 wound up against the inner surface of the tube 154 and an inner coil 174 wound directly about the spindle 150. The secondary coil 162 is similarly floated within the air gap 152 between tube 154 and spindle 150 and supported by rods 164 and 166.

By distributing the primary coils on either side of the secondary coils 162, it is possible to provide a zero net radial force on any radial sector of the secondary coil 162 when the coil is centered about spindle 150. This provides an advantage where large tolerances in physical dimensions are desired for manufacturing ease.

The number of primary turns in coil 172 will not be the same as the turns in coil 174 to produce the result of zero net radial force on any radial sector of coil 162. The required division of turns is a function of the MMF distribution within the core and the radius of secondary coil 162.

The above-described embodiments of the present invention are solely illustrative, modifications and improvements being intended within the spirit of the invention. Accordingly, it is intended to define the scope of the invention only in accordance with the following claims.

What is claimed is:

1. A transformer providing low restraint limited motion between transformer windings comprising:

first and second transformer windings having a common axis;

first and second elements;

a core structure of high permeability material surrounding and passing through said first and second windings to provide a high permeability flux circuit substantially free of low permeability gaps for mutual flux between said first and second transformer windings;

said core structure being configured to contain said first and second transformer windings to permit relative motion therebetween;

means for rigidly supporting said first and second transformer windings to said first and second elements independent of said core structure and each other to permit relative rotary motion therebetween about said axis;

said core structure including apertures for said support means to accommodate limited relative rotary motion between said first and second transformer windings about said axis;

said core structure providing a path for mutual flux of said first and second transformer windings substantially without air gaps therein without providing a low reluctance path to leakage flux.

2. The transformer of claim 1 wherein said core structure includes:

a hollow tube of high permeability material having a central spindle therein of high permeability material;

said first and second transformer windings being substantially annular in shape to fit about the spindle of said core structure within the tube thereof;

end sections of high permeability material completing a magnetic circuit between said tube and spindle at respective ends thereof.

3. The transformer of claim 2 wherein said support means includes at least one strut supporting said first transformer winding through apertures in one of said end sections, said apertures being limited in size to correspond to the desired degree of motion of said first transformer winding about the spindle of said core structure.

4. The transformer of claim 2 wherein said first and second transformer windings are displaced from each other axially along said central spindle.

5. The transformer of claim 1 wherein said core structure high permeability material includes Ferrite.

6. A transformer providing low restraint limited motion between transformer windings comprising:

first and second transformer windings having a common axis;

first and second elements;

a core structure for said first and second transformer windings and including a first portion of high permeability material for conducting magnetic flux centrally through said first and second transformer windings and a second portion for conducting magnetic flux peripherally about said first and second transformer windings from one end section of said first portion to an opposite end section of said first portion;

said core structure thereby providing a high permeability path for mutual flux coupling said first and second transformer windings substantially free of low reluctance gaps therein and a substantially lower flux path for leakage flux coupling only one of said first and second transformer windings;

said core structure being further configured to contain said first and second transformer windings to permit relative rotary motion therebetween;

means for rigidly supporting said first and second transformer windings to said first and second elements respectively independent of said core structure and each other to permit said relative rotary motion therebetween;

said core structure including apertures for said support means to accommodate limited relative rotary motion between said first and second transformer windings.

7. The transformer of claim 6 wherein said first and second windings are displaced from each other axially along said core structure first portion.

* * * * *

UNITED STATES PATENT AND TRADEMARK OFFICE

CERTIFICATE OF CORRECTION

PATENT NO. : 4,117,436

DATED : September 26, 1978

INVENTOR(S) : Alexander G. MacLennan

It is certified that error appears in the above—identified patent and that said Letters Patent is hereby corrected as shown below:

Column 1, line 25, "impedance but" should read --impedance, but--.

Column 3, line 17, "prove" should read --proves--.

Column 3, line 27, "is relatively" should read --is a relatively--.

Column 3, line 29, "spindle 15," should read --spindle 14,--.

Signed and Sealed this

*Twentieth* Day of *December 1983*

[SEAL]

*Attest:*

GERALD J. MOSSINGHOFF

*Attesting Officer*

*Commissioner of Patents and Trademarks*